US005711127A

United States Patent [19]

Sabourin

[11] Patent Number: 5,711,127

[45] Date of Patent: Jan. 27, 1998

[54] ROOF SHINGLE

[76] Inventor: Brunelle P. Sabourin, 21203-95th Avenue, Langley, British Columbia, Canada, V1M 1M1

[21] Appl. No.: 811,224

[22] Filed: Mar. 5, 1997

[51] Int. Cl.[6] ..... E04D 1/26

[52] U.S. Cl. ..... 52/530; 52/533; 52/519; 52/545; 52/547

[58] Field of Search ..... 52/520, 529, 531, 52/534, 545, 547, 555, 519, 533

[56] References Cited

U.S. PATENT DOCUMENTS

| | | | |
|---|---|---|---|
| 5,455,099 | 10/1995 | Banner | 52/531 X |
| 5,469,680 | 11/1995 | Hunt | 52/531 X |
| 5,495,654 | 3/1996 | Goodhart et al. | 52/529 X |
| 5,537,792 | 7/1996 | Mollere | 52/531 |
| 5,613,337 | 3/1997 | Plath et al. | 52/529 X |
| 5,657,603 | 8/1997 | Goodhart et al. | 52/531 X |

*Primary Examiner*—Carl D. Friedman
*Assistant Examiner*—Yvonne Horton-Richardson
*Attorney, Agent, or Firm*—Long and Cameron

[57] ABSTRACT

A roof shingle has parallel top and bottom marginal edge portion which are turned inwardly of a central area and are interengageable with like bottom and top marginal edge portions, respectively, of like roof shingles. The shingle further comprising, at each side thereof, an upper side marginal edge portion and a lower side marginal edge portion, which are inclined relative to said parallel top and bottom marginal edge portions, respectively, so as to converge with one another; and are interengageable with like lower and upper side edge marginal portions, respectively, of like roof shingles.

6 Claims, 2 Drawing Sheets

ROOF SHINGLE

BACKGROUND OF THE INVENTION

1. Field of the Invention

The present invention relates to roof shingles and is useful in particular, but not exclusively, to metal shingles, for example those made of coated aluminum.

2. Description of the Related Art

In the past, various proposals have been made to provide roof shingles made of sheet metal. For example, in Canadian Patent 504,550, issued Jul. 27, 1954 to Louis J. Korter, there is disclosed a shingle having an outurned side edge marginal portion and a horizontal upper edge marginal portion, which is also outurned, with a nailing tab. The rear of this prior art shingle has an inturned gutter edge marginal portion and an inturned opposite side edge marginal portion. By means of these marginal edge portions, the tile can be interengaged with a plurality of similar tiles when installed.

It is, however, a disadvantage of the rectangular shape of this prior art roof shingle that, for aesthetic reasons, and more particularly in order to avoid the visual impression of an unduly large roof shingle, the dimensions of this prior art shingle must be limited.

BRIEF SUMMARY OF THE INVENTION

According to this invention, there is provided a roof shingle which has parallel top and bottom marginal edge portions turned inwardly of a central area of the shingle, so that the top marginal edge portion overlies the central area and the bottom marginal edge portion underlies the central area, the top and bottom marginal edge portions being inter-engageable with like bottom and top marginal edge portions of like shingles. The present roof shingle further comprises, at each side thereof, an upper side marginal edge portion and a lower side marginal edge portion, which are inclined relative to the parallel top and bottom marginal edge portions so as to converge with one another. The upper and lower side edge marginal portions are turned inwardly of the central area, so that the upper side edge marginal portions overlie the central area and the lower side edge marginal portions underlie the central area. The upper and lower side edge marginal portions are inter-engageable with like lower and upper side edge marginal portions of like shingles.

When a roof shingle according to the present invention is installed on a roof in inter-engagement with a plurality of like shingles, the bottom marginal edge portion of the shingle is offset from those of the laterally adjacent shingles. Consequently, the present shingle may be made relatively large, i.e. the major central area may be made large, without having the effect that the assembly of such shingles on a roof is aesthetically unpleasing.

It is a further advantage that when shingles according to the present invention are being installed on a roof, the installer may work from the left to the right of the roofer or in the opposite direction, depending for example on the type and location of the roof.

Also, the appearance of a roof or which the present shingles are installed is enhanced by the fact that, when viewed from either side of the roof, overlapping edges of the shingles will be apparent.

In the preferred embodiment of the invention, the upper and lower side marginal edge portions, at each side of the shingle, are of substantially the same lengths and converge at substantially one-half of the distance between the top and bottom marginal edge portions of the shingle, so that the central area of the shingle comprises top and bottom halves which are, at least substantially, mirror images of one another.

The relatively large area of the present shingle has the advantage that during manufacture of the shingle when a multiplicity of the shingles are being stamped from a coiled sheet of material, the amount of waste material which is left between the shingles is relatively small. Also, the larger area enables the shingle to be stepped on, without stepping and, possibly, damaging the marginal edge portions of the shingle.

In a preferred embodiment of the invention, nailing tabs project from the tops of opposite sides of the roof shingle, each of the nailing tabs being integral with a respective one of the upper side edge marginal portions and being turned relative thereto so as to overlie that one of the upper side edge marginal portions, the nailing tab including an outermost portion and being bent so that the outermost portion is co-planar with the central area.

BRIEF DESCRIPTION OF THE DRAWINGS

The invention will be more readily understood from the following description thereof when taken in conjunction with the accompanying drawings, in which.

DESCRIPTION OF THE PREFERRED EMBODIMENT

Figure 1:
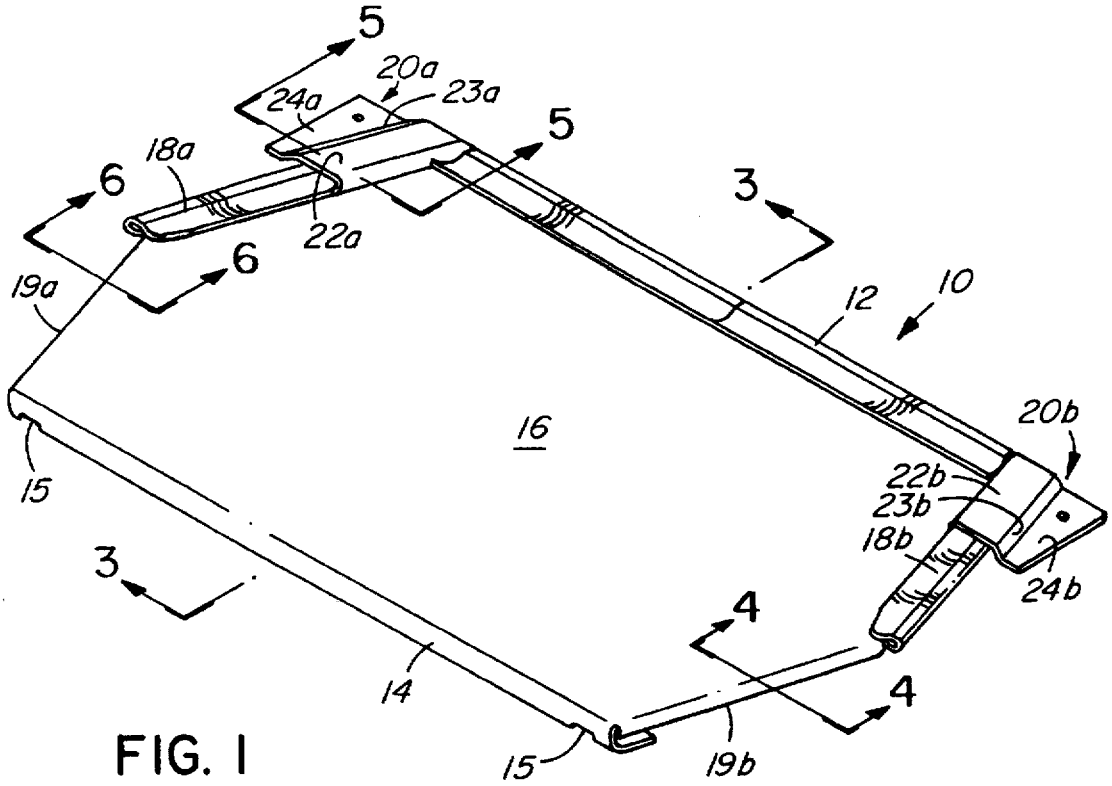
FIG. 1 shows a view perspective of a roof shingle according to the present invention.
Figure 2:
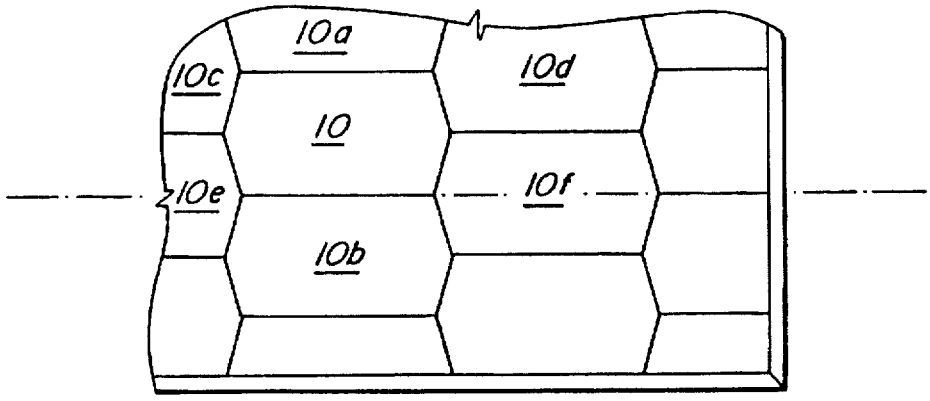
FIG. 2 shows a plan view, broken-away of part of a roof covered with shingles according to the present invention.

In FIG. 1 of the accompanying drawings, there is indicated a roof shingle indicated generally by reference numeral 10 which has a top marginal edge portion 12 and a bottom marginal edge portion 14, which is formed with drainage holes 15. The top marginal edge portion 12 is turned so as to overlie a central area 16 of the shingle, and the bottom marginal edge portion 14 is turned so as to underlie this central area 16. The purpose of the top and bottom edge marginal portions 12 and 14, as will be apparent to those skilled in the art, is to enable the shingle 10 to be inter-engaged with corresponding top and bottom marginal edge portions of adjacent shingles 10*a* and 10*b* as shown in FIG. 2.

Thus, the top edge marginal portion 12 is engageable with a bottom edge marginal portion of a like adjacent shingle 10*a* (FIG. 2) and the bottom edge marginal portion 14 is engageable with the top edge marginal portion of a like shingle 10*b*.

At its opposite sides, the roof shingle 10 has upper side edge marginal portions 18*a* and 18*b*, and lower side edge marginal portions 19*a* and 19*b*.

The upper side edge marginal portions 18*a* and 18*b* are turned so as to overlie the central area 16 of the roofing shingle 10, while the lower side edge marginal portions 19*a* and 19b are turned so as to underlie the central area 16. Thus, the upper side edge marginal portion 18a can be inter-engaged a lower side edge marginal portion, corresponding to the marginal portion 19b, of a like laterally adjacent shingle 10c (FIG. 2), and likewise the upper side edge marginal portion 18b can be inter-engaged with a lower side edge marginal portion, corresponding to the marginal portion 19a, of another laterally adjacent shingle 10d.

The lower side edge marginal portions 19a and 19b are likewise inter-engageable with the upper side edge marginal portions of adjacent shingles 10e and 10f, respectively.

When the shingle 10 is assembled in inter-engagement in this way with a plurality of adjacent shingles 10a–10f, the bottom edge of the shingle 10a, overlying the top edge marginal portion 12 of the shingle 10, will cause rainwater to flow downwardly onto the central area 16 of the shingle 10 and, likewise, the overlapping lower side marginal edge portions of the shingles 10c and 10d will cause rain water to flow downwardly from the shingles 10c and 10d onto the central area 16 of the shingle 10. Also, the lower side marginal edge portions 19a and 19b and the bottom edge marginal portion 14 of the shingle 10 will cause water to flow from the central area 16 of the shingle 10 onto the shingles 10e, 10f and 10b.

The shingle 10 is also formed with two nailing tabs indicated generally by reference numerals 20a and 20b, which have innermost portions 22a and 22b, which are integral with the edges of the upper side edge marginal portions 18a and 18b, respectively, and which are turned outwardly so as to overlie the upper side edge marginal portions 18a and 18b. The nailing tabs 20a and 20b are bent, along bend lines 23a, 23b, so that outermost portions 24a and 24b of these tabs are co-planar with the central area 16 of the shingle 10.

It is possible to omit one of the nailing tabs 20a and 20b. However, the provision of the two nailing tabs 20a and 20b at opposite sides of the roof shingle 10 has the advantage that the roof shingle 10 can be cut vertically, between the opposite sides of the roof shingle 10, in order to adapt the roof shingle to fit at one side or the other of a roof on which the shingles are being installed.

The shingle 10 is made of aluminum sheet material provided with a corrosion-resistant coating of polyester or, preferably, fluorocarbon material, the aluminum having a thickness of at least 0.019".

The upper side edge marginal portions 18a and 18b and the lower edge marginal edge portions 19a and 19b are inclined relative to the top edge marginal portion 12 and the bottom edge marginal portion 14, respectively, so as to converge with one another. The inclination of the upper and lower side edge marginal portions 18a, 18b and 19a, 19b, together with the inter-engaged adjacent shingles, counteracts water seepage beneath the roof shingle 10 at the opposite sides of the roof shingle 10.

Also, since the roof shingle 10 has the six-sided shape shown in the drawings, so as to inter-engage with six adjacent roof shingles, the resultant array of seven inter-engaged roof shingles mutually reinforce one another in resisting the effect of wind or other natural elements tending to displace or lift the roof shingles from the roof on which they are installed.

Since the upper side edge marginal portions 18a and 18b converge with the lower side edge marginal portions 19a and 19b, respectively, at a location which is substantially equidistant from the top and bottom of the shingle, the bottom edges of the adjacent shingles 10c and 10d are aligned at this location, rather than being aligned with the bottom marginal edge portion 14 of the shingle 10, as would be the case if the shingle 10 were a rectangular shingle in lateral alignment with laterally adjacent rectangular shingles. Consequently, the size of the central area 16, and in particular the space in between the top and bottom marginal edge portions 12 and 14, may be made substantially larger than is feasible with rectangular roof shingles. This relatively large size of the present roof shingle 10 has a number of advantages. Firstly, it enables the roof shingle to be more economically manufactured by stamping from a sheet of aluminum material having a corrosion-resistant coating, with less waste material. Also, the relatively large size of the present shingle facilitates and expedites the installation of shingles on a roof and the present shingle, when installed, has a sufficiently central area 16 to enable the central area 16 to be stepped on, without stepping on the marginal edge portions of the shingle and, thereby, damaging these marginal edge portions.

Since each shingle, when installed, is offset from the two adjacent shingles, as illustrated in FIG. 2, this relatively larger size of the present shingle is not aesthetically unsightly and unpleasing. Furthermore, when viewed from one side or the other of the roof on which the present shingles are installed, the overlapping edges of the side marginal edge portions of the roof will always be visible, thus enhancing the appearance of the roof.

Figure 3:
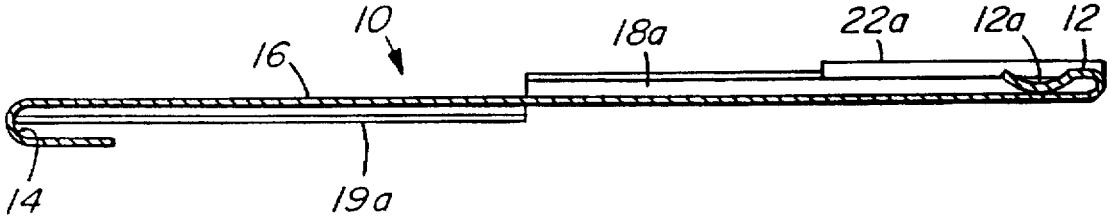
FIG. 3 through 6 show broken-away views taken in section along the lines 3—3, 4—4, 5—5, 6—6, respectively, of FIG. 1.

As can be seen from FIGS. 1 and 3, the top edge marginal portion 12 is formed along its length with an upwardly concave depression 12a, which facilitates tight interengagement of the marginal portion 12 with the bottom marginal portion 14 of an adjacent shingle and counteracts water seepage between these marginal portions.

Figure 4:
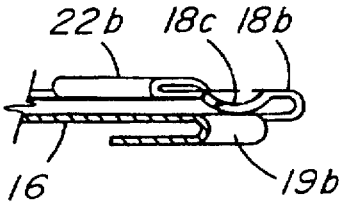
Figure 5:
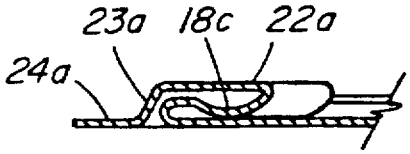
Figure 6:
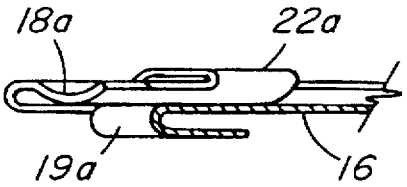
Figure 8:
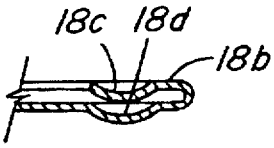
FIG. 8 shows a broken-away view in section along the line 8—8 of FIG. 1.

Likewise, the upper side edge marginal portions 18a and 18b, are formed with upwardly concave depressions 18c and 18d for the same purpose as shown in FIGS. 4, 5 and 8 and the margins of the central area 16 underlying the depressions 18 core formed with corresponding depressions 18d, as shown in FIG. 8.

Figure 7:
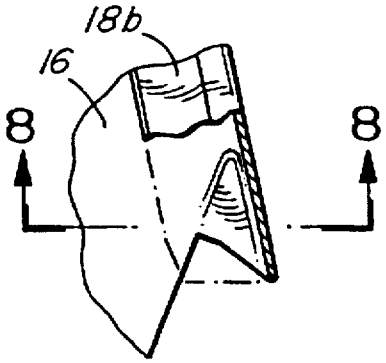
FIG. 7 shows in plan view a broken-away portion of the shingle of FIGS. 1–6.

As shown in FIG. 7, the margin of the central area 16 underlying the upper side edge marginal portion 18b is formed with a triangular depression 16a and a notch 16 to counteract leakage at this location.

The bend in the metal of the shingle where the nail tabs 20a and 20b are attached to the rest of the shingle can flex slightly, while the shingle is in use, to accommodate expansion and contraction of the shingle in response to atmospheric temperature variations.

If desired, the central area 16 of the shingle may be formed with ribs or other corrugations to improve the appearance of the shingle and/or to strengthen the shingle.

Also, if required, the shingle 10 can be bent along a line connecting the points at which the upper and lower side marginal portions 18a, 18b and 19a, 19b meet one another. Such bending may be useful, for example, to adapt the shingle to changes in the slope of a roof.

Although the present roof shingle is made of coated aluminum sheet material, it is envisaged that the present roof shingle may alternatively be made, for example, of vinyl or other plastic material, by molding or by any other suitable process.

The six-sided shape of the above-described shingle 10, with the overlying and underlying opposite side marginal edge portions 18a, 18b and 19a, 19b provides substantial resistance to being lifted off from its roof when installed, as indicated above, and also the angled sides both resist seepage of water to beneath the shingle 10 and also facilitate run-off of water and leaves and other debris from the roof.

Also, the present shingle may be marked, e.g. by stamping or imprinting, with a centerline to facilitate alignment of the shingle with a chalk line as it is positioned on the roof during installation.

As will be apparent to those skilled in the art, the above-described roof shingle may be modified within the scope and spirit of the appended claims.

I claim:

1. A roof shingle, comprising:

a major central area;

parallel top and bottom marginal edge portions which are turned inwardly of said central area so that said top marginal edge portion overlies said central area and said bottom marginal edge portion underlies said central area, and so that said top and bottom marginal edge portions are interengageable with like bottom and top marginal edge portions, respectively, of like roof shingles;

said roof shingle further comprising, at each side thereof, an upper side marginal edge portion and a lower side marginal edge portion, which are inclined relative to said parallel top and bottom marginal edge portions, respectively, so as to converge with one another; and said upper and lower side edge marginal portions being turned inwardly of said central area so that said upper side edge marginal portions overlie said central area and said lower side edge marginal portions underlie said central area and so that said upper and lower side edge marginal portions are interengageable with like lower and upper side edge marginal portions, respectively, of like roof shingles.

2. A roof shingle as claimed in claim 1, including drainage holes in said bottom edge marginal portion.

3. A roof shingle as claimed in claim 1, including at least one nailing tab projecting at the top of one side of said roof shingle.

4. A roof shingle as claimed in claim 3, wherein said nailing tab is integral with a respective one of said upper side edge marginal portions and is turned relative thereto so as to overlie said respective one of said upper side edge marginal portions, said nailing tab including an outermost portion and being bent so that said outermost portion is co-planar with said central area.

5. A roof shingle as claimed in claim 1, made of aluminum sheet material with a corrosion-resistant coating.

6. A roof shingle of aluminum sheet material, comprising:

a major central area;

parallel top and bottom marginal edge portion which are turned inwardly of said central area so that said top marginal edge portion overlies said central area and said bottom marginal edge portion underlies said central area, and so that said top and bottom marginal edge portions are interengageable with like bottom and top marginal edge portions, respectively, of like roof shingles;

said roof shingle further comprising, at each side thereof, an upper side marginal edge portion and a lower side marginal edge portion, which are inclined relative to said parallel top and bottom marginal edge portions, respectively, so as to converge with one another; and said upper and lower side edge marginal portions being turned inwardly of said central area so that said upper side edge marginal portions overlie said central area and said lower side edge marginal portions underlie said central area and so that said upper and lower side edge marginal portions are interengageable with like lower and upper side edge marginal portions, respectively, of like roof shingles; at least one nailing tab projecting at the top of one side of said roof shingle, said nailing tab being integral with a respective one of said upper side edge marginal portions and being turned relative thereto so as to overlie said respective one of said upper side edge marginal portions, and said nailing tab including an outermost portion and being bent so that said outermost portion is co-planar with said central area; and a corrosion resistant coating on said aluminum sheet material.

* * * * *